United States Patent [19]

Palazzo

[11] Patent Number: 5,045,263

[45] **Date of Patent: * Sep. 3, 1991**

[54] METHOD OF MAKING A DOUBLE WALL STORAGE TANK

[76] Inventor: David T. Palazzo, P.O. Box 290676, Tampa, Fla. 33687

[ * ] Notice: The portion of the term of this patent subsequent to Apr. 4, 2006 has been disclaimed.

[21] Appl. No.: 478,346

[22] Filed: Feb. 12, 1990

Related U.S. Application Data

[63] Continuation-in-part of Ser. No. 332,806, Apr. 3, 1989, Pat. No. 4,927,050, which is a continuation-in-part of Ser. No. 194,387, May 16, 1988, Pat. No. 4,817,817, which is a continuation-in-part of Ser. No. 105,890, Oct. 7, 1987, Pat. No. 4,780,947, and a continuation-in-part of Ser. No. 105,881, Oct. 7, 1987, Pat. No. 4,780,946, which is a continuation-in-part of Ser. No. 43,634, Jun. 11, 1987, Pat. No. 4,744,137, which is a division of Ser. No. 884,481, Jul. 11, 1986, abandoned, and a continuation-in-part of Ser. No. 884,389, Apr. 7, 1987, Pat. No. 4,655,367, which is a continuation-in-part of Ser. No. 818,258, Jan. 13, 1986, Pat. No. 4,644,627, which is a continuation-in-part of Ser. No. 775,140, Sep. 12, 1985, Pat. No. 4,640,439.

[51] Int. Cl.[5] ..... B29C 39/10; B29C 39/12

[52] U.S. Cl. ..... 264/137; 264/154; 264/255; 264/257

[58] Field of Search ..... 264/129, 154, 130, 255, 264/135, 136, 137, 257, 258

[56] References Cited

U.S. PATENT DOCUMENTS

| | | | |
|---|---|---|---|
| 3,848,765 | 11/1974 | Durkop | 220/9 A |
| 4,523,454 | 6/1985 | Sharp | 73/49.2 |
| 4,524,609 | 6/1985 | Sharp | 73/49.2 |
| 4,537,328 | 8/1985 | Keesee et al. | 220/445 |
| 4,625,892 | 12/1986 | Carlin, Jr. | 220/465 |
| 4,640,439 | 2/1987 | Palazzo | 220/445 |
| 4,651,893 | 3/1987 | Mooney | 220/445 |
| 4,655,367 | 4/1987 | Palazzo | 220/420 |
| 4,744,137 | 5/1988 | Palazzo | 220/445 |
| 4,780,946 | 11/1988 | Palazzo | 220/445 |
| 4,780,947 | 11/1988 | Palazzo | 220/445 |
| 4,817,817 | 4/1989 | Palazzo | 220/445 |
| 4,913,310 | 4/1990 | Sharp | 220/445 |
| 4,927,050 | 5/1990 | Palazzo | 220/445 |

*Primary Examiner*—Jay H. Woo
*Assistant Examiner*—Jeremiah F. Durkin, II
*Attorney, Agent, or Firm*—Pettis & McDonald

[57] ABSTRACT

A method of making a double wall tank from a single wall inner tank. A mixture of an internal lubricating agent and a curable synthetic resin is formed and applied over an exterior portion of the tank which when cured forms a rigid outer sheath that is fluid tight and resists bonding to the inner tank.

9 Claims, 1 Drawing Sheet

METHOD OF MAKING A DOUBLE WALL STORAGE TANK

This is a continuation-in-part of application Ser. No. 332,806, filed Apr. 3, 1989, now issued as U.S. Pat. No. 4,927,050 entitled "Method of Making Double Wall Storage Tank For Liquids From a Metal Tank Having a Patterned Surface" which is a continuation-in-part of application Ser. No. 194,387 filed May 16, 1988 and issued as U.S. Pat. No. 4,817,817, entitled "Double Wall Storage Tank and Method of Making Same" which is a continuation-in-part of application Ser. No. 105,890 filed Oct. 7, 1987, and issued as U.S. Pat. No. 4,780,947, entitled "Method of Making Double Wall Storage Tank with Channeled Spacer Means" and of application Ser. No. 105,881, filed Oct. 7, 1987, and issued as U.S. Pat. No. 4,780,946 entitled "Method of Making Double Wall Storage Tank with Beaded Spacer Means, which were continuations-in-part of applications Ser. No. 43,634 filed June 11, 1987, and issued as U.S. Pat. No. 4,744,137, which application is a division of application Ser. No. 884,481 filed July 11, 1986, and now abandoned and was also a continuation-in-part of application Ser. No. 884,389 filed Apr. 7, 1987, which issued as U.S. Pat. No. 4,655,367 entitled "Double Wall Storage Tank for Liquids," which was a continuation-in-part of application Ser. No. 818,258 filed Jan. 13, 1986, now issued as U.S. Pat. NO. 4,644,627 entitled "Method of Making Double Wall Storage Tank for Liquids," which was a continuation-in-part of original application Ser. No. 775,140 filed Sept. 12, 1985, now issued as U.S. Pat. No. 4,640,439 entitled "Double Wall Storage Tank and Method of Making Same," all of the above having been filed in the name of David T. Palazzo.

FIELD OF THE INVENTION

This invention relates to a double wall tank for the storage, of liquids and an improved method for making such a double wall storage tank.

BACKGROUND OF THE INVENTION

Tanks for the storage of liquids have been constructed in a variety of ways from a variety of materials. In one common application, the underground storage of hydrocarbons, such as gasoline and other petroleum products, the tanks have conventionally been fabricated out of steel or fiberglass, most commonly with a single rigid wall. In many applications this construction has proved reasonably satisfactory, with such tanks functioning properly for many years before requiring repair or replacement. However, the increasing age of many of the tanks currently in place is beginning to present serious environmental dangers. Many of the older steel tanks buried underground have rusted and are beginning to leak, thus releasing the petroleum materials into the ground where they may seep into and pollute underground water supplies. While rustproof, some fiberglass tanks have also exhibited leakage, causing the same problems.

One of the primary problems with leaking storage tanks has been the difficulty or inability to ascertain when or if such leaks are occurring from a given tank. Because the excavation and removal of such a storage tank, which may contain thousands of gallons of fuel, is an expensive and difficult undertaking, such an operation is difficult to justify unless there is some evidence of actual leakage.

Because of the increasing potential danger of leaking storage tanks, particularly in communities that utilize ground water for public consumption, many municipalities have implemented or plan to implement ordinances requiring the use of double wall storage tanks underground and requiring replacement of existing single wall tanks. While the installation of a conventional double wall tank in a new facility entails no great difficulty and a generally manageable increase in cost over a single wall tank, the burden of complying with such ordinances by replacing existing sound, single wall tanks with double wall tanks can be heavy. This burden has promoted the search for methods of fabricating relatively inexpensive double wall tanks. This burden has also given impetus to the search for a method of remanufacturing existing single wall tanks into a double wall assembly with means for detecting the presence of any leaks into the space between the two walls.

A number of techniques have been disclosed for converting single wall tank into double wall tank and providing such tanks with the means for detecting the presence of leaks. Such methods are shown for example in my U.S. Pat. Nos. 4,640,439, 4,644,627, 4,655,367, 4,744,137, 4,780,946, 4,780,947 and 4,817,817. Although these techniques provide for quite acceptable double wall tanks, they do require the employment of a perforated spacing material such as mesh, or alternatively, a molded spacing material that must be constructed and applied to the inner tank or alternatively the application of a release agent directly to the tank. The labor and time involved in constructing and installing these spacing materials or applying a separate coating of release agent can be significant and the need exists to reduce even further the cost of producing such double wall tanks.

SUMMARY OF THE INVENTION

In view of the foregoing it is the object of the present invention to provide an improved, economical method of manufacturing a double wall storage tank from a single wall tank by providing an outer sheath enclosing the single wall tank. It is a further object of this invention to provide such a method in which at least a portion of the outer sheath of the tank is free of engagement with the outer surface of such inner tank.

To achieve these and other objects that will become readily apparent to those skilled in the art, this invention provides a method of manufacturing a double wall tank for storage of liquids from a single wall inner tank. This method includes the step of forming a mixture of an internal lubricating agent and a curable synthetic resin, applying over that inner tank exterior surface the curable synthetic resin and lubricating agent mixture that, when cured, creates a substantial rigid outer sheath that is substantially liquid-tight and that resists bonding to the inner tank, whereby is formed a double wall tank in which the inner tank defines an inner wall and the outer sheath defines an outer wall.

BRIEF DESCRIPTION OF THE DRAWINGS

Particularly preferred embodiments of the method and apparatus of this invention will be described in detail below in connection with the drawings in which.

DESCRIPTION OF PREFERRED EMBODIMENT

Figure 1:
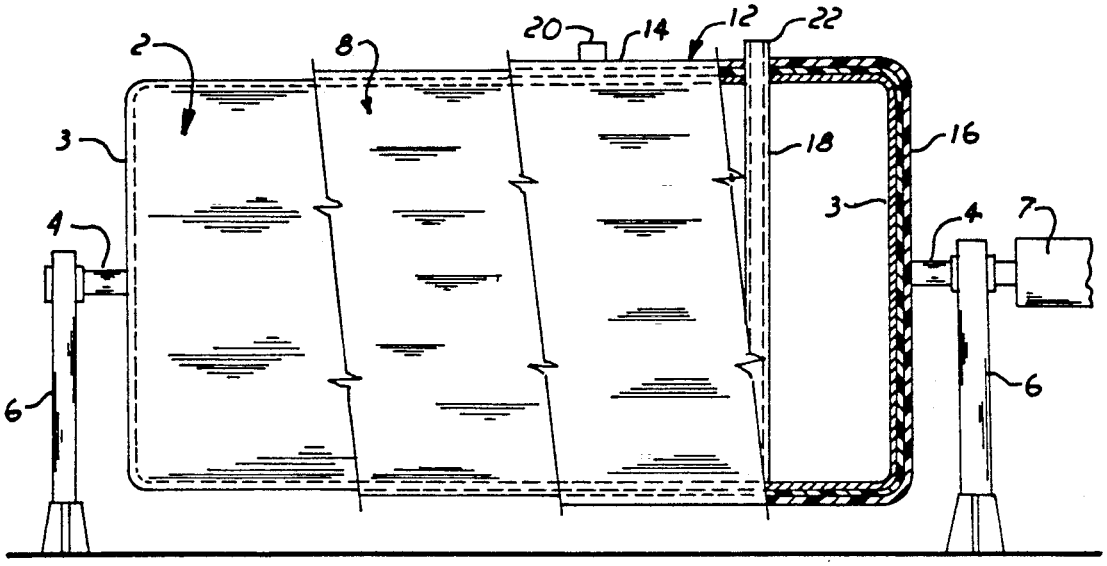
FIG. 1 is a side elevational view, partially in section, of a tank according to the present invention, illustrating various steps in the fabrication process.
Figure 2:
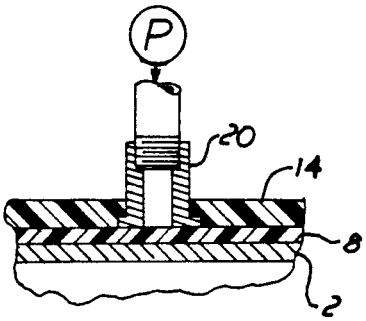
FIG. 2 is a fragmentary side sectional view of a portion of the tank according to this invention and of an apparatus and technique for breaking adhesion between the outer sheath and the inner tanks.

A preferred embodiment of the apparatus of this invention is illustrated in FIGS. 1 and 2. FIG. 1 is a side elevational view illustrating the manner of making the completed tank assembly by the application of the various materials to the storage tank.

While various forms and shapes of tanks may be utilized in practicing this invention, the most common shape utilized for underground storage is that of a cylinder, generally a right circular cylinder, having closed end portions For simplicity of illustration this configuration of the tank is utilized for illustrating the preferred embodiment of the invention. Also, while virtually any construction of the rigid inner tank, whether of metal or fiberglass or other material, may be utilized in practicing this invention, one preferred and readily available type of structure is a tank formed of welded steel, having an appropriate corrosion resistant coating on the liquid contacting surfaces. For purposes of illustration such a sealed tank will be described. It also is to be understood that the tank to be used could be a newly fabricated tank, which may or may not have any manhole opening cut in it, or it may be a previously used tank removed from its prior underground installation and cleaned for reuse with this invention.

To prepare an uncoated or previously used steel tank, it is preferred, but not required, to simplify subsequent steps by attaching a spindle, as by welding, to the center of each tank head or end portion, generally collinear with the axis of the tank. As shown in FIG. 1, the spindles 4 and thus the inner tank 2 may then be supported off the ground on conventional uprights 6. This provides for rotation of the tank by an appropriate and conventional rotary drive 7 for purposes to be set forth below. Then, it is desirable that the exterior surface of the tank be conventionally sandblasted and coated with a rust inhibitive material 8. This coating material 8 preferably may be a conventional polyester resin incorporating a known paraffin-based tack free additive known to those skilled in the art.

After the surface of the tank has been sandblasted and prepared, the outer sheath may be fabricated in any of a number of different ways. In this preferred embodiment, the rigid outer sheath 12, and particularly the cylindrical sidewall portions 14 thereof, are formed by the application of a resin/lubricant mixture and chopped glass fibers through the "chopper gun" technique. In this method an internal lubricating agent, such as that known in the industry as MOLD WIZ® is mixed in the known manner directly into a curable synthetic resin, and this resin/lubricant mixture is applied over the exterior surface of the inner tank 2, preferably by spraying as the tank is rotated on the spindles 4. This provides preferably a substantially uniform coating over the entire exterior surface of the tank including the end portions 3 thereof. Then, preferably before the coating has begun to set, the resin/lubricant mixture and chopped glass fibers are sprayed over at least the cylindrical sidewall portions of the inner tank by use of the "chopper gun," to form a coating of the desired thickness. If desired, the resin/lubricant mixture may be sprayed through the "chopper gun" with the chopped glass fibers directly onto the inner tank 2 without a preliminary coating of the resin/lubricant mix. Also, if desired, the sheath 12 may be formed by application of the resin/lubricant mix and then laying up of glass fiber matting, with subsequent additional coating of the resin/lubricant mix, in place of the use of the chopper gun. Also, after the initial coating over the tank of the resin/lubricant mix and the application of the glass fiber matting, conventional resins without the lubricant may then be applied, if desired.

While the thickness of the outer sheath 12 may vary according to the severity of conditions anticipated, it should be of sufficient thickness to provide a substantial rigid sheath. It has been found that one-quarter inch thickness of the cured, resin impregnated glass fiber material generally provides sufficient strength and rigidity for the sheath 12.

To form the end portions 16 of the sheath, when laying on the matting rather than spraying, the glass fiber mat impregnated with the resin/lubricant mixture may simply be laid and wrapped around the tank end portions, forming a continuous structure with the cylindrical sidewalls. This continuous application of glass fiber material may be effected with the tank still supported with spindles 4, or with those spindles cut off. If the spindles are retained, they may be cut off at a later time and a patch of appropriate resin impregnated glass fiber matting placed over the hole left by the spindle. This continuous lay-up method of forming the end portions 16 of the sheath 12 is illustrated in the partial sectional view at the right hand end of FIG. 1.

In this invention it may be desirable, although not required, to break, at least temporarily, the engagement between the exterior surface of the inner tank 2 and the outer sheath 12 to provide for passage of liquids between the exterior of tank 2 and the outer sheath. Accordingly, as shown in FIG. 2, a suitable fitting or other means are provided for introduction of a pressurized fluid P between the exterior surface of the inner tank 2 and the outer sheath 14. Preferably this may be accomplished by inclusion of structures, such as the fitting 20, which may conveniently include a flange on one end and a female thread, such as a pipe thread, on the other end. This fitting 20 may conveniently be pre-coated with fiber glass resin which is sandblasted to roughen the pre-coated surface for improved bonding and then loosely held against the exterior surface of inner tank 2 prior to application of the resin and glass fiber material. Then, as that outer sheath material is applied over the inner tank 2 and around the fitting 20, that fitting will be held in place by the uncured material forming the outer sheath 12, as shown in FIG. 2. Upon completion of the application of the sheath material and curing of the curable resin that comprises that outer sheath 12, the fitting 20 may be firmly bonded in place.

As shown in FIG. 1, the inner tank 2 may also be provided with a tube 18 extending generally diametrically through both sides of the tank, with the lower end extending to a point closely adjacent to one cylindrical sidewall, shown as the lower portion in FIG. 1, and the opposite end shown as the upper portion 22 extending substantially above a generally diametrically opposed portion of the inner tank 2. In fabricating the outer sheath 12, the sheath may be bonded around the portion 22 in a manner generally similar to that described above with respect to fitting 20. Thus, in the completed double wall tank the tube 18 extends from its portion 22 outside the sheath through the adjacent portion of the outer sheath 12 and the sidewall of the inner tank and the opposite sidewall of the inner tank, with its open lower end terminating adjacent the lower portion (FIG. 1) of the outer sheath 12.

To enable the double wall tank formed by the method of this invention to provide for the protection against leaking of fluids to be contained within it, an optional process step may comprise breaking, at least temporarily, any engagement between the inner tank exterior surface and the inner surface of the outer sheath. This step may be performed by application of a fluid under pressure P, such as air, that is sufficient to break, at least temporarily, engagement between the inner tank exterior surface and the outer sheath. Because of the internal lubricating agent contained within the resin, distortion or expansion of the outer sheath 12 caused by application of that fluid P under pressure, suitably through fitting 20, causes that outer sheath 12 to separate and break free from any engagement with inner tank 2. The pressure required may be as little as 1 to 5 pounds per square inch over ambient, and the movement of the sheath from the inner tank under the influence of that pressure may be as small as 1/1,000 of an inch. It is only necessary to break the outer sheath from any substantial bonding to the inner tank in order to provide a path for flow of hydrocarbons between the outer sheath and the inner tank, for purposes to be described below. It is to be understood that it is not necessary to break the outer sheath 12 loose from any engagement with the inner tank 2, as the internal lubricating agent that is combined with the resin will prevent meaningful bonding and thus permit any leaking liquids to flow between the inner tank 2 and the outer sheath 12, even without the pressurization technique for breaking loose any such engagement, as described above.

Figure 3:
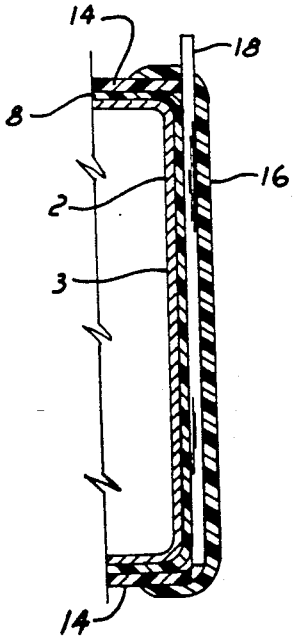
FIG. 3 is a partial side sectional view, similar to the right hand portion of FIG. 1, illustrating a different embodiment of the end structure of the tank of this invention.

As an alternate construction method, the end portions 16 of the sheath 12 ma be fabricated separately from the cylindrical sidewall portion 14. Such a technique, illustrated in the fragmentary sectional view of FIG. 3, provides substantially the same end result as the continuous lay-up process shown in FIG. 1. However, this method of forming the end portions 16 separately may simplify the manufacture by permitting formation of those end caps 16 over a male mold plug, thus permitting the glass fiber material to be laid substantially horizontally instead of vertically, as is required in the continuous lay-up approach of FIG. 1.

As shown in FIG. 3 the tube 18 may, alternatively, be bonded into one, or both, of the end portions 16, extending from a point adjacent the lowermost portion of the interior of the outer sheath 12 through an aperture formed in the upper portion of outer sheath 12. In this embodiment the tube 18 extends between the inner surface of the end portion 16 of the outer sheath 12 and the exterior surface of the end wall of inner tank 2. The pressurized fluid P described above could equally well be introduced through this tube 18 in FIG. 3, or through the corresponding tube 18 illustrated in FIG. 1, instead of through fitting 20.

The remaining steps involved in the manufacture of the double wall talk of this invention may be substantially the same as those described in detail in my prior patents U.S. Pat. Nos. 4,640,439, 4,644,627, 4,655,367 and U.S. Pat. No. 4,817,817, the teachings of which patents are incorporated herein by reference.

By the foregoing construction there is thus provided a double wall tank that can be manufactured economically from a conventional steel wall tank, and even from a used tank that has previously been removed from underground storage. This structure provides an outer sheath, which may be formed from a material that is free of any tendency to rust or corrode, and which is free from any bonding with the inner tank to permit the collection within the space between the inner tank and the outer sheath, and thus detection, of any liquids leaking into that space, either from the tank or from sources exterior to the sheath. Thus may be determined the existence of any leakage of either the tank or the sheath by simply detecting the presence and nature of any liquid present in that space. Additionally, leakage may be detected by applying a positive or negative pressure to the tank or to the space between the exterior surface of inner tank 2 and the interior of outer sheath 12 and then observing to determine if that level of pressure is maintained, all as is known in the prior art. By the use of a relatively thick and rigid outer sheath, the strength of that sheath is enhanced over similar structures that may use a flexible outer covering. Furthermore, such a rigid external sheath permits testing of the integrity of the sheath and tank at substantial pressures, which could not be done with a flexible covering without danger of rupture. As an additional desirable feature, the space between the inner and outer tanks is formed without the need for any substantially rigid spacer material, thereby saving both labor and material costs.

While the foregoing describes in detail several preferred embodiments of the tank of this invention, it is to be understood that such description is illustrative only of the principles of the invention and is not to be considered limitative thereof. Because numerous variations and modifications of both the method of manufacture and the resulting tank will readily occur to those skilled in the art, the scope of this invention is to be limited solely by the claims appended hereto.

What is claimed is:

1. A method of manufacturing a double wall tank from a single wall inner tank for storage of liquids, said inner tank including a generally cylindrical sidewall and a pair of end walls, said method comprising forming a mixture of an internal lubricating agent and a curable synthetic resin; and applying over at least a portion of said inner tank exterior surface said mixture of said curable synthetic resin and said lubricating agent to form, when cured, a substantially rigid outer sheath that is substantially fluid tight and that resists bonding to the inner tank.

2. The method of claim 1 wherein said sheath comprises at least one layer of fibrous material coated with a curable resin which, upon curing, provides a coating which is resistent to the passage of water or hydrocarbon liquid.

3. The method of claim 1 wherein said mixture of said curable synthetic resin and said internal lubricating agent is applied to substantially the entire exterior surface of said inner tank.

4. The method of claim 1 wherein said outer sheath has a configuration generally of a cylinder with closed ends, and wherein said mixture of said curable synthetic resin and said internal lubricating agent is applied to said cylindrical sidewall, whereby the lubricating agent will serve to prevent bonding between the outer surface of the cylindrical sidewall of the inner tank and the outer sheath.

5. The method of claim 4 wherein the cylindrical sidewall portions of said outer sheath overlying said inner tank cylindrical sidewall are formed separately from the end portions of said sheath overlying the closed end portions of said inner tank, and wherein said sheath end portions are sealingly joined to said sheath cylindrical wall portions, whereby is formed a continuous outer sheath overlying said inner tank.

6. The method of claim 1 further comprising the step of forming an aperture through said sheath and through a portion of a wall of said inner tank, whereby is provided access to the interior of said inner tank.

7. The method of claim 1 wherein said method further comprises the step of breaking engagement between said inner tank exterior surface and said outer sheath, whereby is formed a double wall tank in which said inner tank defines an inner wall and said outer sheath defines an outer wall.

8. The method of claim 7 wherein said step of breaking engagement includes the step of applying between said inner tank exterior surface and said outer sheath a fluid under a pressure that is sufficient to break, at least temporarily, engagement between said inner tank exterior surface and said outer sheath.

9. The method of claim 8 wherein said step of applying a fluid under pressure includes the steps of connecting a fluid conduit to said double wall tank such that a discharge opening of said conduit is disposed within said outer sheath but outside said inner tank exterior surface, and introducing a pressurized fluid to said conduit to apply a positive fluid pressure between said inner tank exterior surface and said outer sheath.

* * * * *